US011808256B2

(12) United States Patent
Lee et al.

(10) Patent No.: US 11,808,256 B2
(45) Date of Patent: Nov. 7, 2023

(54) COMPRESSOR INCLUDING DISCHARGE PLENUM

(71) Applicant: LG Electronics Inc., Seoul (KR)

(72) Inventors: Youngmun Lee, Seoul (KR); Kyunyoung Lee, Seoul (KR); Kiwon Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 17/222,638

(22) Filed: Apr. 5, 2021

(65) Prior Publication Data

US 2021/0310470 A1 Oct. 7, 2021

(30) Foreign Application Priority Data

Apr. 3, 2020 (KR) ..... 10-2020-0040791

(51) Int. Cl.

| | |
|---|---|
| ***F04B 39/10*** | (2006.01) |
| ***F04B 39/00*** | (2006.01) |
| ***F04B 53/10*** | (2006.01) |
| ***F04B 35/04*** | (2006.01) |

(52) U.S. Cl.

CPC ..... *F04B 39/10* (2013.01); *F04B 35/045* (2013.01); *F04B 39/0005* (2013.01); *F04B 53/10* (2013.01)

(58) Field of Classification Search

CPC ..... F04B 35/04; F04B 35/045; F04B 39/08; F04B 39/10; F04B 39/102; F04B 53/10; F16K 15/023; F16K 1/52; F16K 1/523

USPC ..... 137/516.19, 856

See application file for complete search history.

(56) References Cited

U.S. PATENT DOCUMENTS

| | | | | |
|---|---|---|---|---|
| 2009/0317263 | A1* | 12/2009 | Lee | F04B 39/0292 417/363 |
| 2017/0321677 | A1* | 11/2017 | Kim | F04B 39/1033 |
| 2019/0093645 | A1* | 3/2019 | Lee | F04B 35/04 |
| 2019/0309742 | A1* | 10/2019 | Kim | F04B 39/102 |

FOREIGN PATENT DOCUMENTS

| | | |
|---|---|---|
| KR | 20170086841 | 7/2017 |
| KR | 20190118427 | 10/2019 |
| KR | 102060175 | 12/2019 |

* cited by examiner

*Primary Examiner* — Charles G Freay
*Assistant Examiner* — Chirag Jariwala
(74) *Attorney, Agent, or Firm* — Fish & Richardson P.C.

(57) ABSTRACT

Provided are a discharge plenum integrated with a valve stopper and a linear compressor including the discharge plenum. The valve stopper includes a radial member that extends radially and an axial member that extends axially from a radial inner end of the radial member. The axial member may have a tubular shape. The axial member may define a slot flow path that extends axially. The radial member may include a peripheral hole that extends axially. The radial inner side of the radial member may define a central hole of the axial member. The slot flow path and the peripheral hole may minimize a pressure drop and energy loss of a high-pressure fluid flowing from a compression portion to a discharge portion.

20 Claims, 18 Drawing Sheets

COMPRESSOR INCLUDING DISCHARGE PLENUM

CROSS-REFERENCE TO RELATED APPLICATION

This application claims priority to and the benefit of Korean Patent Application No. 10-2020-0040791, filed on Apr. 3, 2020, the disclosure of which is incorporated herein by reference in its entirety.

BACKGROUND

1. Field of the Disclosure

The present disclosure relates to a discharge plenum integrated with a valve stopper and a linear compressor including the discharge plenum.

2. Description of Related Art

Compressors may receive power from power generating devices such as motors or turbines and compress a working fluid such as air or refrigerant up to high pressure. The compressors may be used in a refrigeration cycle.

Examples of compressors may include a reciprocating compressor defining a compression portion between a piston and a cylinder and configured to compress refrigerant based on linear reciprocation of the piston, a rotary compressor configured to compress fluid by a roller that eccentrically rotates in a cylinder, and a scroll compressor including a pair of spiral scrolls engaged to rotate for compressing a fluid.

Linear compressors may linearly reciprocate a piston without using a crankshaft. The linear compressor may introduce fluid into a compression portion while the piston moves out of a bore of the cylinder and compress the fluid in the compression portion while the piston is deeply inserted into the bore of the cylinder.

In contrast to the reciprocating compressor to change a rotational motion of a drive shaft into a linear reciprocating motion of the piston using the crankshaft and a connecting rod, the linear compressor may directly linearly move the piston. In order to linearly move the piston, the linear compressor may include a moving member that is linearly moved by a linear motor. The moving member may be connected to the piston. In addition, the linear compressor may include a resonance spring to elastically support the piston in linear movement directions of the piston facing each other.

The fluid having compressed in the compression portion defined by the cylinder may be discharged into a discharge portion. A discharge valve may be disposed between the compression portion and the discharge portion and may be opened when the fluid in the compression portion is compressed to a predetermined pressure or higher. The compressed fluid pushes the discharge valve with high pressure. In this case, the discharge valve is opened to discharge the compressed fluid to discharge portion.

A valve stopper is disposed adjacent to the discharge portion configured to adjust a degree of opening the discharge valve to prevent the discharge valve from being pushed out excessively by the high-pressure fluid.

For example, the discharge valve and the valve stopper may be disposed adjacent to the outlet of the cylinder and may be sealed to prevent leakage of the high-pressure fluid. Such a complicated structure may increase a number of components and cause a difficult assembly process.

In addition, as the valve stopper interferes with the discharge valve in a direction of opening the discharge valve, the valve stopper may become an obstacle blocking a flow of the high-pressure fluid discharged when the discharge valve is opened. The structure of the valve stopper may cause a pressure loss of the fluid and decrease energy efficiency.

SUMMARY OF THE DISCLOSURE

The present disclosure provides a discharge plenum capable of simplifying a structure of an outlet of a cylinder of a compressor.

The present disclosure also provides a discharge plenum including a valve stopper to couple a discharge valve, control a degree of opening the discharge valve, and facilitate a flow of fluid without blocking the flow of compressed fluid.

The present disclosure also provides a discharge plenum having high energy efficiency and low pressure loss.

The present disclosure provides a discharge plenum to facilitate manufacturing thereof.

The present disclosure further provides a compressor including the discharge plenum.

Aspects of the present disclosure are not limited to the above-mentioned aspects.

Additionally, other aspects of the present disclosure that have not been mentioned may be understood from the following description and more clearly understood from the embodiments of the present disclosure. In addition, it will be easily understood that the aspects of the present disclosure may be realized via features described in claims and a combination thereof.

An embodiment of the present disclosure relates to a valve stopper of a compressor.

The compressor may be a linear compressor. The plenum may include the valve stopper disposed at the outlet of the cylinder.

The valve stopper may include a radial member that extends radially and an axial member that extends axially from the radial inner end of the radial member. The axial member may have a tubular shape.

The axial member may define a slot flow path that extends axially.

The radial member may include peripheral holes that pass through the radial member axially.

The radial member may define a central hole of the axial member at the radial inner side of the radial member.

The slot flow path and the peripheral hole may minimize pressure drop and energy loss of the high-pressure fluid flowing from the compression portion to the discharge portion.

A linear compressor 1 of an embodiment may include a cylinder 40, a piston 50, a discharge valve assembly 46, and a valve stopper 65.

According to an embodiment, the cylinder 40 may extend axially and define an inlet at a first axial end thereof and an outlet at a second axial end thereof.

According to an embodiment, the piston 50 may be inserted into the cylinder 40 through the inlet of the cylinder 40 and linearly reciprocate axially in the cylinder 40.

According to an embodiment, the discharge valve assembly 46 may be disposed at the outlet of the cylinder 40 to open and close the second axial end of the cylinder 40.

According to an embodiment, the valve stopper 65 may adjust a degree of opening the discharge valve assembly 46.

According to an embodiment, the valve stopper 65 may include a radial member 651, a central hole 652, an axial member 654, an interference surface 655, and a slot flow path 656.

According to an embodiment, the radial member 651 extends radially and the central hole 652 may be defined by radial inner ends of the radial member 651.

According to an embodiment, the axial member 654 has a hollow tubular shape and may extend in a first axial direction from the radial inner end of the radial member 651.

According to an embodiment, the interference surface 655 may be disposed at an axial end of the axial member 654. When the discharge valve assembly 46 is opened, the interference surface 655 interferes with the discharge valve assembly 46 to adjust the degree of opening the discharge valve assembly 46.

According to an embodiment, the slot flow path 656 may be provided at a circumference of the axial member 654 and pass through the axial member 654 in a radial direction. Thus, the slot flow path 654 may communicate the hollow space of the axial member 654 with a circumferential outer space of the axial member 654.

According to an embodiment, the discharge valve assembly 46 may include a valve member 460, a valve spring 464, and a spring holder 466.

According to an embodiment, the valve member 460 may close the outlet of the cylinder 40.

According to an embodiment, the valve spring 464 may apply an elastic force to the valve member 460 in a direction of closing the outlet by the valve member 460.

According to an embodiment, the spring holder 466 may support the valve spring 464 to apply the elastic force to the valve member 460 by the valve spring 464.

According to an embodiment, a radial outer end of the radial member 651 may be connected to a first pipe 611 that extends in the first axial direction from the radial outer end of the radial member 651.

According to an embodiment, a valve mounter 613 may be disposed at an axial end of the first pipe 611 to couple the discharge valve assembly 46 to the cylinder 40. An inner diameter of the valve mounter 613 may be expanded by a step 614.

According to an embodiment, a radial outer end of the radial member 651 may be connected to a second pipe 612 that extends in a second axial direction, which is opposite to the first axial direction, from the radial outer end of the radial member 651.

A discharge cover 80 may be connected to an axial end of the second pipe 612. In this case, the second pipe 612 and the discharge cover 80 may define a discharge portion 88 to receive a high-pressure fluid discharged from a compression portion 44 of the cylinder 40 through the discharge valve assembly 46.

According to an embodiment, a hollow space provided by the axial member 654 may axially communicate with a space provided at a first axial side of the valve stopper 65. That is, the axial member 654 may be open to the forward direction and the rearward direction.

According to an embodiment, the slot flow path 656 may have straight line shape of which an axial length is larger than a circumferential length thereof. The hole may have a straight shape that extends axially.

According to an embodiment, a plurality of slot flow paths 656 may be provided at circumferentially equal distances. The slot flow paths 656 may include, for example, three or four slot flow paths.

The slot flow path 656 may be open to the first axial direction or may be closed to the first axial direction.

The interference surface 655 may have a closed loop ring shape.

According to an embodiment, the radial member 651 may include peripheral holes 653 that pass through the radial member 651 axially.

The peripheral hole 653 may axially communicate a space provided at the first axial side of the valve stopper 65 with a space provided at a second axial side of the valve stopper 65.

The peripheral holes 653 may be provided at circumferentially equal distances. The peripheral holes 653 may be defined around the central hole 652.

The peripheral hole 653 may be an arc-shaped elongated hole and have a circumferential length that is larger than a radial length thereof.

According to an embodiment, the axial member 654 may have a truncated cone shape that gradually decreases in diameter in the first axial direction. In this structure, an outer circumferential surface and an inner circumferential surface of the axial member 654 may have the truncated cone shape.

According to an embodiment, the linear compressor 1 may further include a frame 20 having the cylinder 40 and the valve stopper 65.

According to an embodiment, the frame 20 may include a first inner diameter portion 21, a second inner diameter portion 22, and an inward step 23.

According to an embodiment, the first inner diameter portion 21 may be defined at a first axial side thereof, the second inner diameter portion 22 may be disposed opposite to the first inner diameter portion 21, and the inward step 23 may be defined between the first inner diameter portion 21 and the second inner diameter portion 22.

According to an embodiment, the first inner diameter portion 21 may be concentric with the second inner diameter portion 22. The second inner diameter portion 22 may be defined at a second axial side thereof.

The inward step 23 may be defined between the first inner diameter portion 21 and the second inner diameter portion 22 and may protrude inward radially.

According to an embodiment, the cylinder 40 may be inserted into and coupled to the first inner diameter portion 21.

According to an embodiment, when the cylinder 40 is coupled to the frame 20, the outlet of the cylinder 40 may be inserted into the second inner diameter portion 22 through the inward step 23.

According to an embodiment, the discharge valve assembly 46 may be accommodated in the second inner diameter portion 22.

According to an embodiment, the discharge valve assembly 46 may be axially disposed between the outlet of the cylinder 40 and the valve mounter 613.

The linear compressor may further include a linear motor 30 to linearly reciprocate the piston 50.

The use of the discharge plenum is not limited to the linear compressor. That is, the discharge plenum may be disposed in other types of compressors.

Further, according to the present disclosure, the compressor includes the discharge plenum to simplify the structure of the outlet of the cylinder of the compressor.

Further, according to the present disclosure, the valve stopper smoothly guides the flow of the compressed fluid without blocking the flow of the compressed fluid.

Further, according to the present disclosure, the compressor has high energy efficiency and low pressure loss.

Further, according to the present disclosure, the discharge plenum may be easily manufactured and assembled.

Further effects of the present disclosure, in addition to the above-mentioned effects, are described together with explanation of specific matters for carrying out the disclosure.

BRIEF DESCRIPTION OF THE DRAWINGS

FIG. 9 is a perspective view showing the discharge plenum of the linear compressor in

FIG. 7.

DETAILED DESCRIPTION OF EXEMPLARY IMPLEMENTATIONS

Figure 1:
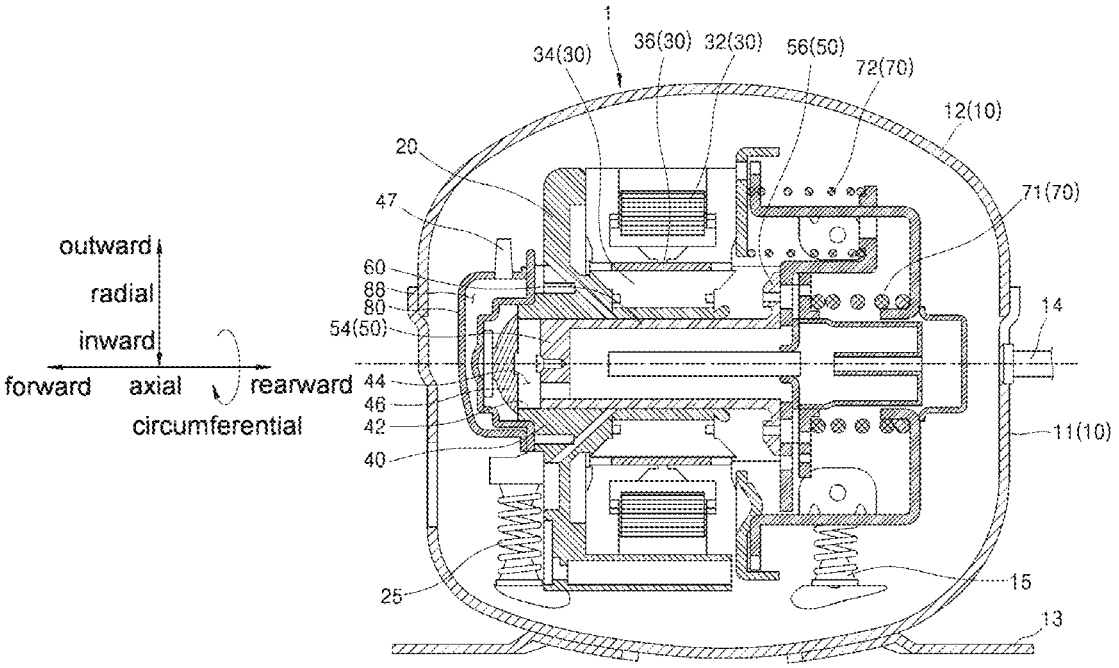
FIG. 1 is a side cross-sectional view of an example linear compressor.

Some embodiments of the present disclosure are described with reference to accompanying drawings, such that a person having ordinary knowledge in the art to which the present disclosure pertains may easily implement the technical idea of the present disclosure. A description of known technology relating to the present disclosure may be omitted if it unnecessarily obscures the gist of the present disclosure. Hereinafter, one or more embodiments of the present disclosure are described in detail with reference to the accompanying drawings. The same or like reference numerals may be used to refer to the same or like components in the figures.

In the following description of the embodiments, an axial direction refers to a linear reciprocating direction of a piston. A forward direction refers to a direction in parallel to a direction of axially pushing the piston into a cylinder. A rearward direction refers to a direction in parallel to a direction of axially removing the piston from the cylinder. If the rearward direction is a first axial direction, the forward direction may be a second axial direction. A radial direction refers to a direction moving away from or moving toward the axis. A centrifugal direction refers to a direction moving away from the axis and a centripetal direction refers to a direction moving toward the axis. A circumferential direction refers to a direction surrounding a circumference of the axis.

In some examples, terms such as first, second, and the like may be used herein when describing elements of the present disclosure, but the elements are not limited to those terms. These terms are intended to distinguish one element from other elements, and the first element may be a second element unless otherwise stated.

Unless otherwise stated, each component may be singular or plural throughout the disclosure.

The terms "connected," "coupled," or the like are used the that, where a first component is connected or coupled to a second component, the first component may be directly connected or able to be connected to the second component, or one or more additional components may be disposed between the first and second components, or the first and second components may be connected or coupled through one or more additional components.

As used herein, the singular forms "a," "an" and "the" are intended to include the plural forms as well, unless the context clearly indicates otherwise. In the present disclosure, it should not be construed that terms such as "including" or "comprising" necessarily include various types of components or various steps described in the present disclosure, and it should be construed terms such as "including" or "comprising" do not include some components or some steps or may include additional components or steps.

In addition, as used herein, the singular forms "a," "an" and "the" are intended to include the plural forms as well, unless the context clearly indicates otherwise. In the present disclosure, it should not be construed that terms such as "including" or "comprising" necessarily include various types of components or various steps described in the present disclosure, and it should be construed terms such as "including" or "comprising" do not include some components or some steps or may include additional components or steps.

In the present disclosure, unless otherwise stated, "A and/or B" means A, B, or both. Unless otherwise stated, "C to D" means "C or more and D or less".

Hereinafter, a piston structure of a linear compressor according to some embodiments of the present disclosure is described.

[Structure of Linear Compressor]

A structure of a linear compressor is described with reference to FIG. 1. A linear compressor 1 includes a piston 50 that linearly reciprocates in a cylinder 40. A space of a compression portion 44 defined by the cylinder 40 and the piston 50 is repeatedly increased and decreased in volume as the piston 50 linearly reciprocates. A linear motor 30 is disposed at an outer circumference of the cylinder 40 to linearly reciprocate the piston 50. The linear motor 30 includes a pair of annular stators 32 and 34 having different diameters, and a moving member 36 disposed between the pair of stators 32 and 34. The moving member 36 is connected to the piston 50 and linearly reciprocates with the piston 50 integrally.

The fluid compressing structure is disposed inside a shell 10. An inner space of the shell 10 is isolated from an outside by the shell 10. According to an embodiment, the shell 10 includes a container-shaped body shell 11 opened to a top and a lead shell 12 to cover the top of the body shell 11. The body shell 11 and the lead shell 12 may each be manufactured, for example, by pressing sheet metal. An ear mount 13 is disposed on a lower surface of the body shell 11 to couple the shell 10. An inlet pipe 14 is connected to the shell 10, and a refrigerant flows into the inner space of the shell 10 through the inlet pipe 14. The shape and the assembly manner of the shell are not limited to those of the shell 10 of the embodiment.

A plurality of installation pins 15 protrude upward and are disposed at a bottom of the shell 10. In addition, an elastic body 25 such as a coil spring is disposed on each of the plurality of installation pins 15. A frame 20 including the cylinder 40, the piston 50, and the linear motor 30 is disposed on the elastic body 25. In this case, vibration generated when the piston 50 linearly and axially reciprocates in the cylinder 40 may not be transmitted to the shell 10. The type and installation manner of the elastic body are not limited to those of the coil spring of the embodiment. For example, a leaf spring may be used or a method of hanging the frame 20 on a wire may be used.

The frame 20 includes the cylinder 40. The cylinder 40 may be integrated with the frame 20, which simplifies that the cylinder 40 and the frame 20 are manufactured as separate components and then assembled to form an integrated structure or are manufactured as one component.

The cylinder 40 has a cylindrical shape, extends axially, and has an axial front portion covered by a discharge valve assembly 46 and an axial rear portion defining an opening. The discharge valve assembly 46 includes a valve member that is opened based on a pressure having a predetermined value or more. A discharge cover 80 is disposed in front of the discharge valve assembly 46. The discharge cover 80 is coupled to the frame 20. An inner space provided by the discharge cover 80 and the discharge valve assembly 46 corresponds to a discharge portion 88.

The compression portion 44 is defined by the discharge valve assembly 46, a bore 42 of the cylinder 40, and a head 54 of the piston 50.

The fluid compressed in the compression portion 44 is discharged to the discharge portion 88 through the discharge valve assembly 46.

The piston 50 includes the head 54, a piston body 57, and a flange 56. The head 54 is disposed at an axial front side of the piston 50 and faces the compression portion 44. A cross section of the head 54 corresponds to an inner cross section of the bore 42 of the cylinder 40. A check valve is disposed on the head 54. The check valve allows fluid in a space provided axially behind the head 54 to flow into the compression portion 44 and prevents a backflow of the fluid in the compression portion 44 to the space provided axially behind the head 54.

The piston body 57 has a cylindrical shape and extends axially rearward from a radial outer end of the head 54. The piston body 57 slides in contact with the bore 42 of the cylinder 40. The piston body 57 is subjected to a predetermined surface treatment to reduce a coefficient of friction and abrasion of the piston body 57 against the bore 42 of the cylinder 40. For example, such a surface treatment may increase hardness of the surface and minimize roughness of the surface to smooth the surface. Examples of the surface treatment may include polytetrafluoroethylene (PTFE) coating, diamond-like-carbon (DLC) coating, and anodizing. In an embodiment, the DLC treatment is performed.

A flange 56 is connected to an axial rear end of the piston body 57. The flange 56 extends outward from the piston body 57 in the radial direction thereof.

The linear motor 30 is a driving means to linearly reciprocate the piston 50 and includes a stator and a moving member. The stator may be coupled to the frame 20. The stator includes an inner stator 34 disposed at an outer circumference of the cylinder 40 and an outer stator 32 spaced apart from the inner stator 34 in a radial outward direction thereof. The moving member 36 may be disposed between the outer stator 32 and the inner stator 34 to linearly reciprocate in the axial direction. A winding coil may be disposed on the outer stator 32 and the moving member 36 may include a permanent magnet. When a current is applied to the linear motor 30, flux is generated in the stators 32 and 34 by the winding coil. The flux interacts with flux of the permanent magnet of the moving member 36 to linearly reciprocate the moving member 36 in a forward and rearward direction thereof. However, the structure and the operation principle of the linear motor are not limited to thereto.

A rear end of the moving member 36 is coupled to the flange 56 of the piston 50. In this state, the moving member 36 moves in the forward and rearward direction together with the piston 50.

In addition, the piston 50 is connected to a resonance spring 70. The resonance spring 70 is connected to the piston 50 through the flange 56. The resonance spring 70 may include a first spring 71 and a second spring 72 to elastically press the piston 50 in a forward direction and a rearward direction, respectively. In the embodiment, a compression coil spring is used as the resonance spring 70. However, the type of spring is not limited thereto.

A first end of each of the first spring 71 and the second spring 72 is supported by the frame 20 and a second end of each of the first spring 71 and the second spring 72 pressurizes the piston 50 in a direction opposite to each other. The resonance spring 70 magnifies the vibration generated based on the linear reciprocation of the moving member 36 and the piston 50 to efficiently compress the fluid.

[Operation of Linear Compressor]

An embodiment described below exemplifies a low pressure compressor including a shell 10 providing a low-pressure inner space. However, the technical idea of the present disclosure is not limited thereto.

When a linear motor 30 operates, a piston 50 linearly reciprocates axially. When the piston 50 moves rearward, a volume of a compression portion 44 is increased and a volume of an inner space of the shell 10 except for the compression portion 44 is decreased. In this case, as a pressure of fluid in an inner space of the compression portion 44 is significantly lower than a pressure of fluid in the inner space of the shell 10, a check valve disposed at a head 54 of the piston 50 is opened and the fluid (e.g., refrigerant) in the inner space of the shell 10 is introduced into the compression portion 44.

When the piston 50 moves forward, the volume of the compression portion 44 is decreased and the volume of the inner space of the shell 10 except for the compression portion 44 is increased. In this case, as the pressure of the fluid in the inner space of the compression portion 44 is significantly higher than the pressure of the fluid in the inner space of the shell 10, the check valve disposed at the head 54 of the piston 50 is closed and the fluid in the compression portion 44 does not flow back to the inner space of the shell 10. The volume of the inner space of the shell 10 is increased as the piston 50 moves forward and the fluid (e.g., the refrigerant) is introduced into the shell 10 through an inlet pipe 14.

As the piston 50 moves forward, the fluid in the compression portion 44 is compressed at high pressure. When the fluid is compressed to a predetermined pressure or more, the high-pressure fluid is discharged to the discharge portion 88 through a discharge valve assembly 46 disposed at a front side of the compression portion 44 of the cylinder 40. The high-pressure fluid is discharged to the outside of the shell 10 through a discharge port 47 and a discharge pipe.

In a refrigeration cycle, the inlet pipe 14 may be connected to an evaporator and the discharge pipe may be connected to a condenser.

When the moving member 36 and the piston 50 move forward and rearward, the resonance spring 70 magnifies the forward and rearward movement of the piston. As vibration generated when the piston 50 and related components move forward and rearward is reduced by the elastic body 25, the vibration is not transmitted to the shell 10.

[Discharge valve assembly]

Figure 2:
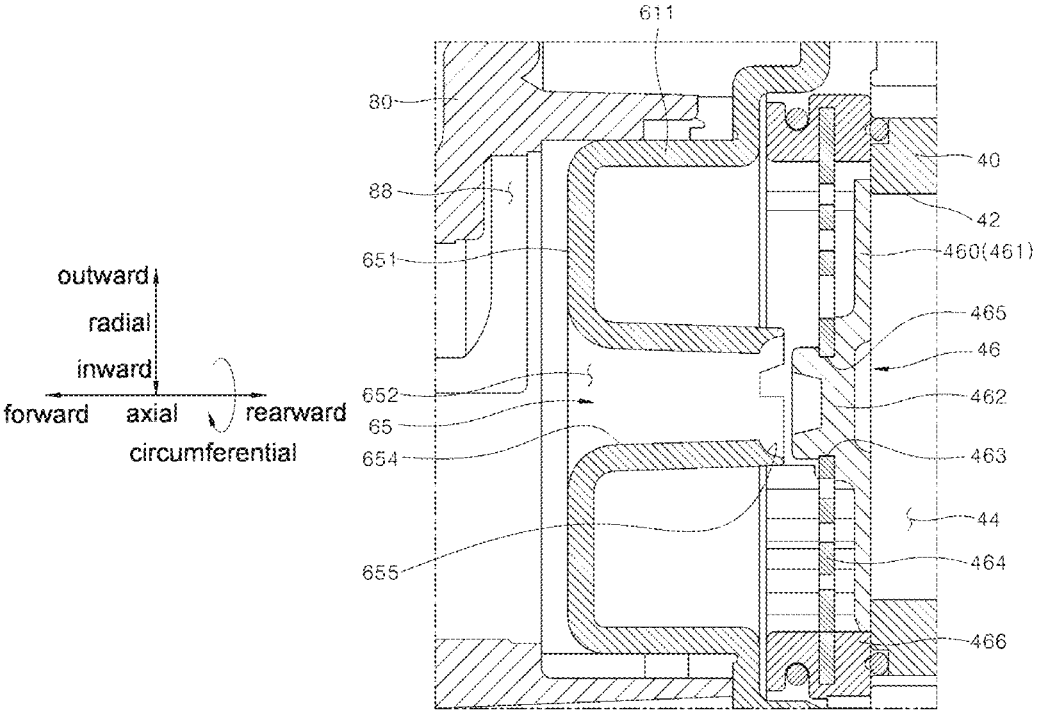
FIG. 2 is an enlarged side cross-sectional view of an example outlet of a cylinder of a linear compressor.

Hereinafter, a structure of a discharge valve assembly 46 of a linear compressor is described with reference to FIG. 2. The compressor shown in FIG. 2 has a structure different from that of the compressor shown in FIG. 1.

The discharge valve assembly 46 includes a valve member 460, a valve spring 464, and a spring holder 466. The valve member 460 opens and closes an outlet of the cylinder 40. The valve spring 464 provides an elastic force to the valve member 460 in a direction of closing the outlet of the cylinder 40 by the valve member 460. The spring holder 466 supports the valve spring 464 and couples the discharge valve assembly 46 to a front side of the cylinder 40.

The valve member 460 includes a disc-shaped valve plate 461 having a diameter that is larger than that of an inner circumferential surface of the cylinder 40, that is, that of the bore 42 and being concentric with the cylinder 40, and an axial protrusion 462 that extends axially forward from a center of the valve plate 461.

The valve spring 464 may be a leaf spring that extends radially. A radial inner end of the valve spring 464 provides a fitting hole 465 and a spring mount 463 disposed on an outer circumferential surface of the axial protrusion 462 is inserted into the fitting hole 465. In this case, the radial inner end of the valve spring 464 axially restrains the axial protrusion 462. That is, when the valve member 460 moves forward (e.g., in a direction of opening the valve), the axial protrusion 462 interferes with the radial inner end of the valve spring 464 and receives elastic resistance from the valve spring 464.

A radial outer end of the valve spring 464 is coupled to the spring holder 466. The spring holder 466 has an annular ring shape. As an inner diameter of the spring holder 466 is larger than an outer diameter of the valve member 460, the spring holder 466 and the valve member 460 do not interfere with each other in a state where the spring holder 466 is concentric with the valve member 460. The spring holder 466 is coupled to a front end of the cylinder 40. FIG. 2 shows a sealing ring disposed between the spring holder 466 and the cylinder 40 to prevent fluid leakage. However, the position of the sealing ring to prevent the leakage of the high-pressure fluid is not necessarily limited thereto.

The spring holder 466 of the discharge valve assembly 46 is coupled to the cylinder 40 by a valve stopper 65. The valve stopper 65 blocks the valve member 460 from being excessively opened. The valve stopper 65 interferes with the axial protrusion 462 of the valve member 460 to adjust a range of forward movement of the valve member 460, that is, a degree of opening the valve.

A discharge cover 80 is disposed in front of the valve stopper 65 in the axial direction thereof and defines a discharge portion 88.

[Valve Stopper]

Figure 3:
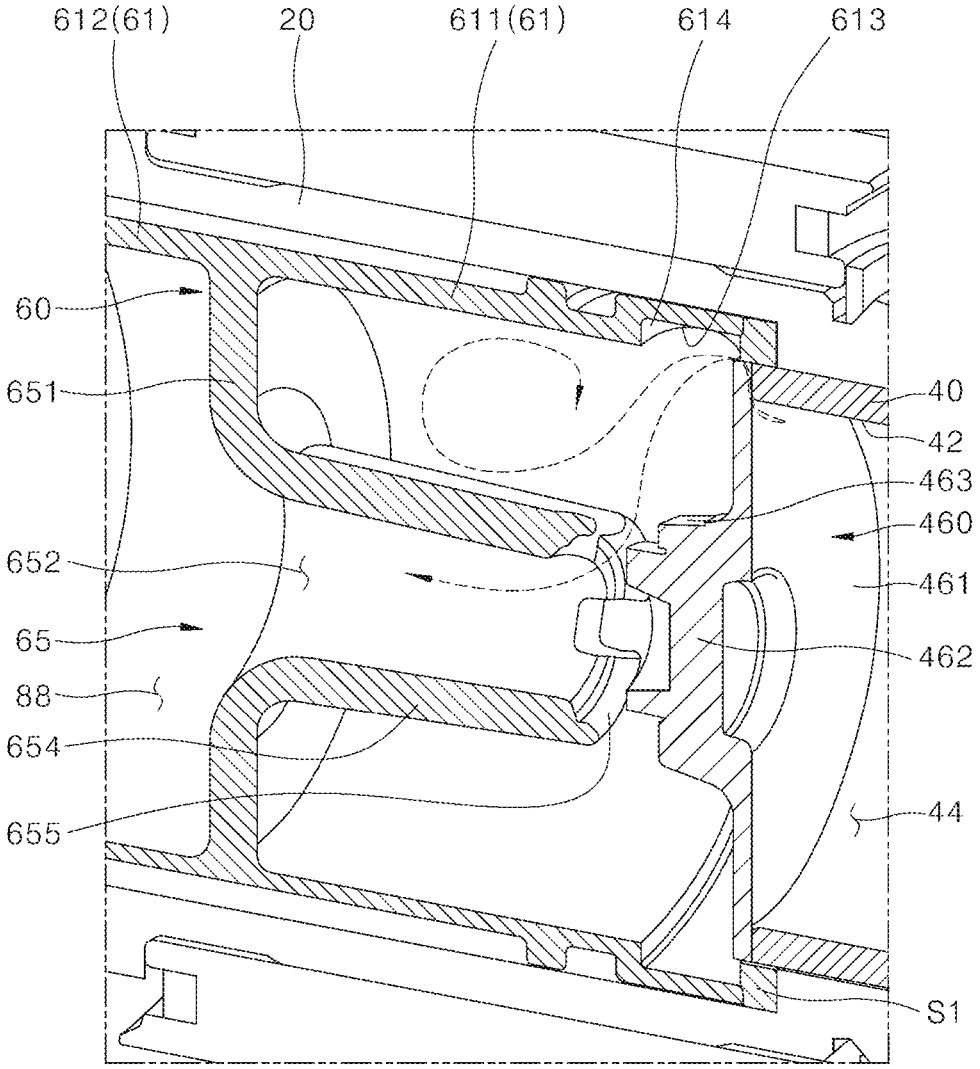
FIG. 3 is an enlarged cross-sectional perspective view showing an example outlet of a cylinder of a linear compressor.
Figure 4:
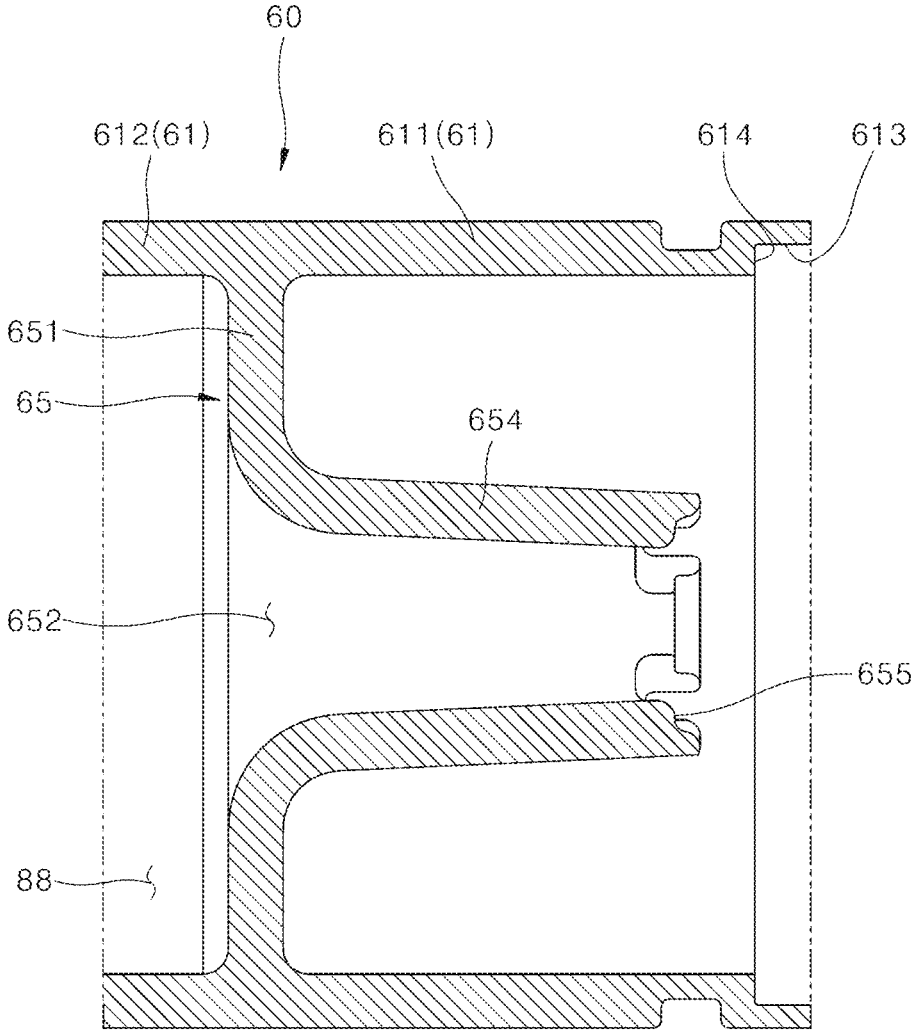
FIG. 4 is a side cross-sectional view of a valve stopper in FIG. 3.

Hereinafter, a structure of a valve stopper 65 of a linear compressor is described with reference to FIGS. 3 and 4. The compressor shown in FIG. 3 has a structure different from that of each of the compressor in FIG. 1 and the compressor in FIG. 2. In FIG. 3, a valve spring 464 and a spring holder 466 of a discharge valve assembly 46 are omitted.

The valve stopper 65 includes a radial member 651 that extends radially and an axial member 654 that extends axially. The radial member 651 may have a disk shape and include a central hole 652. A radial inner side of the radial member 651 is connected to the axial member 654. The axial member 654 extends axially rearward from the radial member 651. The axial member 654 may have a tubular shape, and an outer diameter and an inner diameter thereof are gradually decreased in the rearward direction. An interference surface 655 is disposed at a rear end of the axial member 654. When the valve member 460 is opened and is moved forward axially, the interference surface 655 interferes with the axial protrusion 462 of the valve member 460 to adjust a degree of moving the valve member 460 in the forward direction.

A radial outer side of the radial member 651 is connected to a first pipe 611. The first pipe 611 extends rearward from the radial member 651 in the axial direction thereof. The first pipe 611 has a longitudinal shape and extends further rearward than the axial member 654 and a rear end of the first pipe 611 may pressurize a sealing member (S1) to seal between the first pipe 611 and the frame 20. The cylinder 40 is inserted into the frame 20 and is integrated with the frame 20. An outer circumferential surface of a front end of the cylinder 40 contacts the sealing member (S1). In this case, the high-pressure gas in the compression portion 44 pushes the valve member 460 and is discharged to the discharge portion 88. The leakage of the high-pressure fluid discharged to the discharge portion 88 is prevented by the sealing member (S1).

An inner diameter of the rear end of the first pipe 611 is increased by a step 614. The step 614 and the expanded inner circumferential surface form a valve mounter 613. The valve mounter 613 supports an outer circumferential surface and an axial front surface of the spring holder 466 of the discharge valve assembly 46. When the first pipe 611 is pressurized in a rearward direction and coupled, the spring holder 466 supported by the valve mounter 613 is disposed and coupled between the step 614 and the sealing member (S1).

As indicated by dotted lines in FIG. 3, the high-pressure fluid pushes the valve member 460 to open the valve member 460 and is discharged to the discharge portion 88 through the valve stopper 65 via a gap between the interference surface 655 of the valve stopper 65 and the axial protrusion 462 of the valve member 460.

The fluid having compressed in the compression portion 44 exits from the compression portion 44 through the radial outer end of the valve member 460. Meanwhile, the radial member 651 and the axial member 654 of the valve stopper 65 define a dead end space at the radial outer circumference of the axial member 654. Therefore, air flowing from the valve member 460 may cause recirculation in the dead end space.

Figure 5:
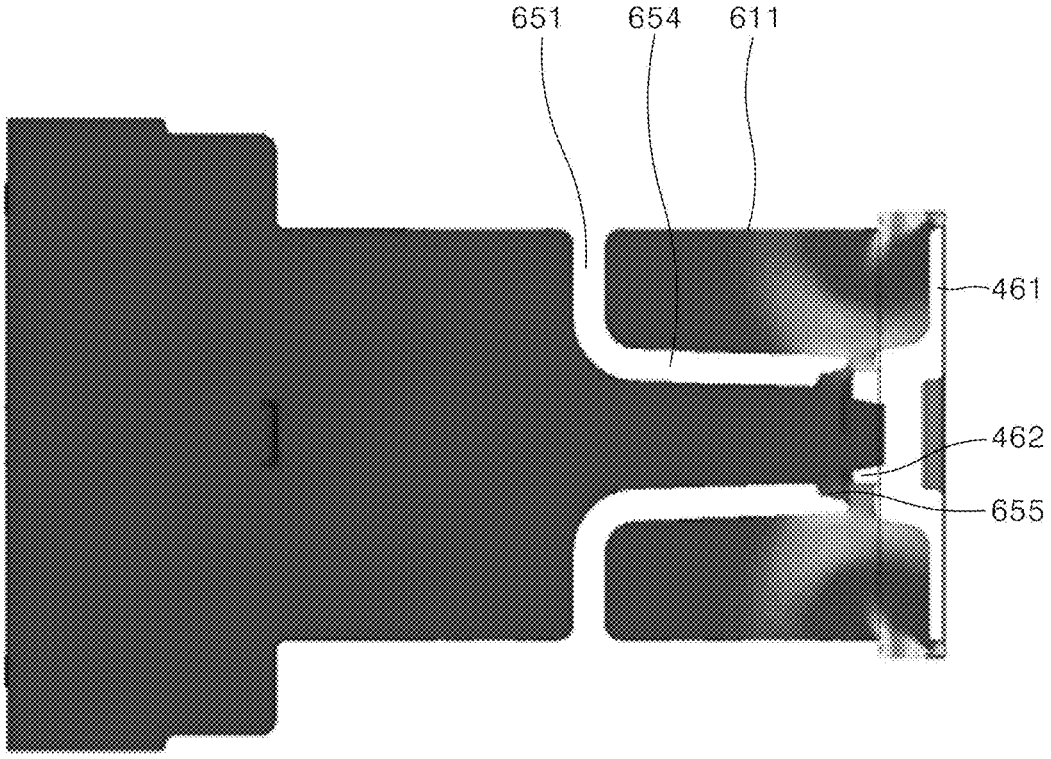
FIGS. 5 and 6 show pressure distribution and a velocity vector of fluid determined when the fluid is discharged from a compression portion of the linear compressor in FIG. 3.
Figure 6:
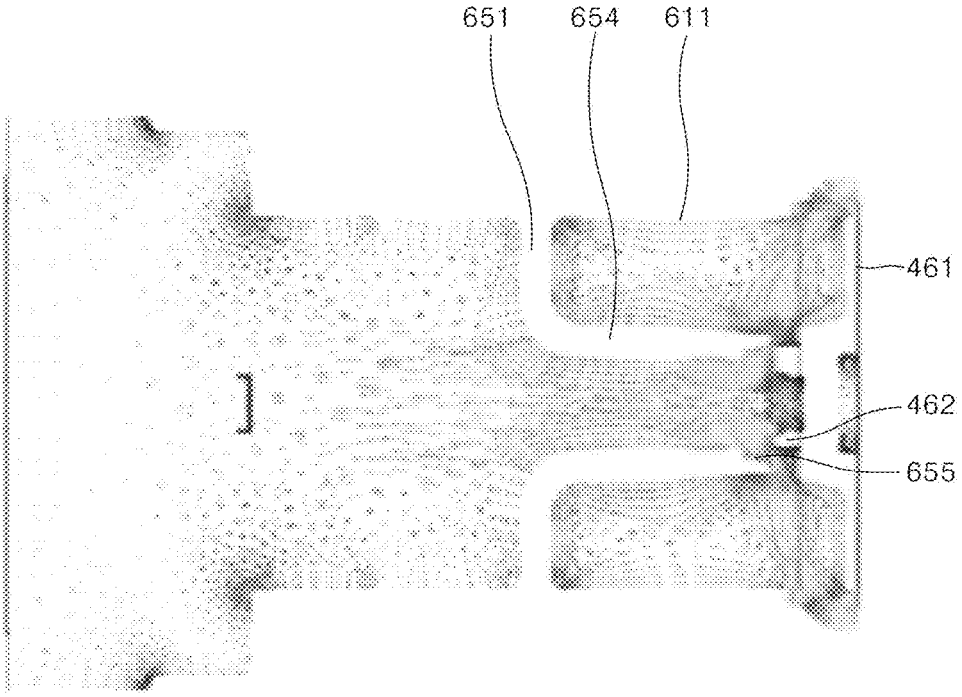
Figure 7:
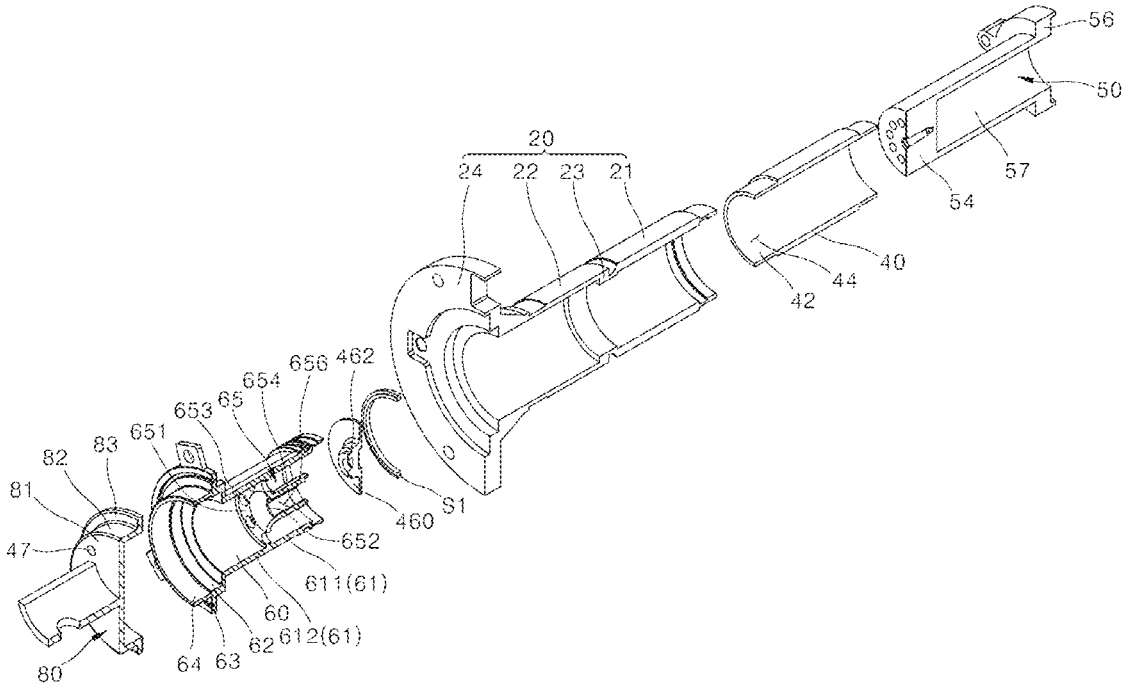
FIG. 7 is an exploded cross-sectional perspective view showing a frame, a cylinder, a piston, a discharge plenum, and a discharge cover of a linear compressor.
Figure 8:
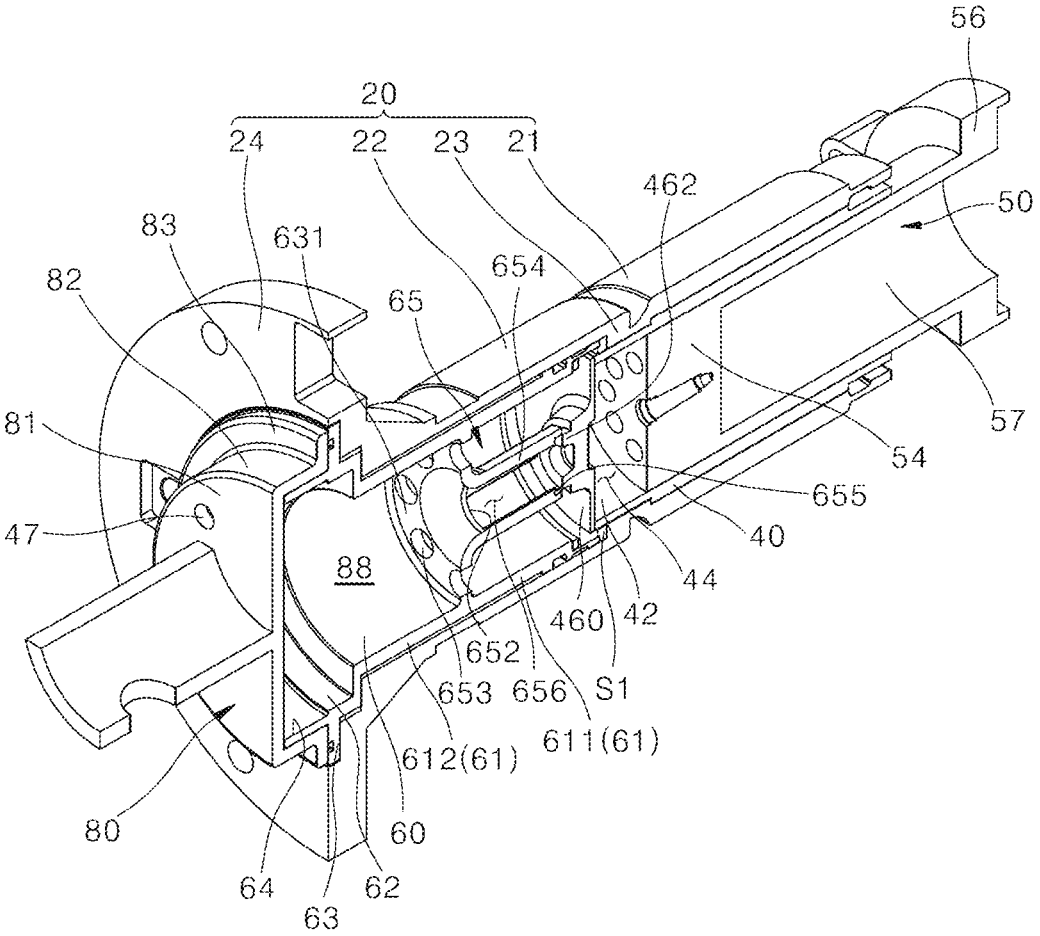
FIG. 8 is a cross-sectional perspective view showing the frame, the cylinder, the piston, the discharge plenum, and the discharge cover of the linear compressor in FIG. 7 in an assembled state.
Figure 9:
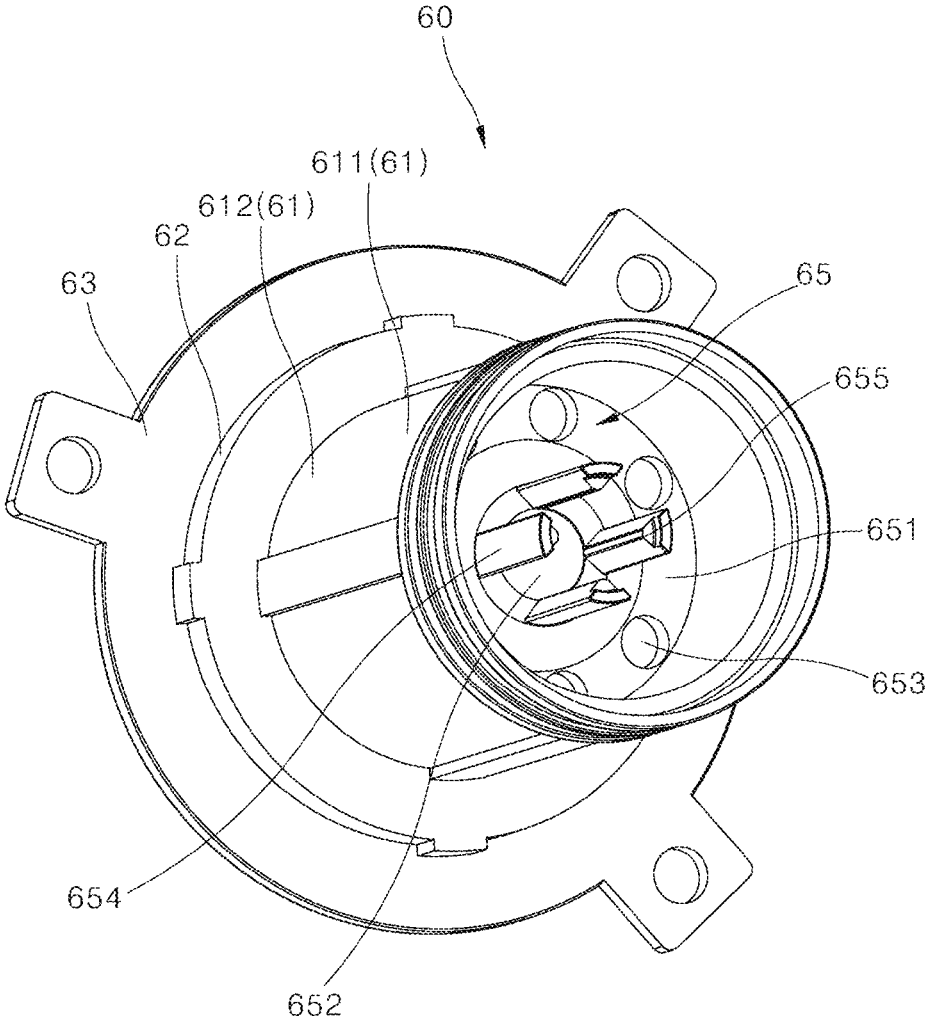

As shown in FIG. 5, the recirculating air may cause pressure loss while exiting through the narrow gap between the interference surface 655 of the valve stopper 65 and the axial protrusion 462 of the valve member 460. In addition, as shown in FIG. 6, all flows are concentrated in the narrow gap between the interference surface 655 of the valve stopper 65 and the axial protrusion 462 of the valve member 460, thereby causing the flow loss.

[Discharge Plenum]

Hereinafter, a discharge plenum 60 integrated with a valve stopper 65 to improve pressure loss and flow loss, and a frame 20 using the discharge plenum 60 are described with reference to FIGS. 7 to 12.

The frame 20 of a compressor 1 may have a longitudinal cylindrical shape that extends in a forward and rearward direction thereof. The frame 20 may be open in a forward direction and a rearward direction and include a flange 24 that extends radially at a front end thereof. The frame 20 includes an inward step 23 that protrudes inward radially at an axial central portion thereof. The frame 20 includes a first inner diameter portion 21 at a rear side of the inward step 23 and a second inner diameter portion 22 at front side of the inward step 23. The first inner diameter portion 21 has an inner diameter that is larger than that of the inward step 23 and the second inner diameter portion 22 has an inner diameter that is larger than that of the inward step 23. In the embodiment, the second inner diameter portion 22 has the inner diameter that is larger than that of the first inner diameter portion 21. However, the second inner diameter portion 22 may be concentric with the first inner diameter portion 21 and does not necessarily have the same inner diameter as the first inner diameter portion 21.

A cylinder 40 is inserted into the first inner diameter portion 21 through the rear portion of the frame 20. The piston 50 continuously slides in contact with a surface of a bore 42 of the cylinder 40 and a predetermined mirror polishing treatment may be applied to the surface of the bore 42. According to the embodiment, the cylindrical cylinder 40 is manufactured in a simple cylindrical shape and the inner circumferential surface of the cylinder 40 is surface-treated and then the cylinder 40 is inserted into the first inner diameter portion 21, thereby reducing cost of the surface treatment.

An insertion depth of the cylinder 40 into the first inner diameter portion 21 may be adjusted by the inward step 23. For example, an outer circumferential surface of the cylinder 40 has a size corresponding to that of the inner circumferential surface of the first inner diameter portion 21 and the front end of the cylinder 40 has a shape complementary to that of the inward step 23 such that the insertion depth of the cylinder 40 is accurately adjusted. When the cylinder 40 is inserted into the first inner diameter portion 21, the front end of the cylinder 40 may protrude further forward than the inward step 23.

The piston 50 may be inserted into the cylinder 40 through the rear side of the cylinder 40. When the piston body 57 continuously slides in the cylinder 40, an outer circumferential surface of the piston body 57 contacts the inner circumferential surface of the cylinder 40. Therefore, an outer circumferential surface of the piston body 57 may be surface-treated. A flange 56 disposed at a rear end of the piston 50 and that extends radially is not inserted into the cylinder 40.

The discharge plenum 60 is inserted into the second inner diameter portion 22 through a front side of the frame 20. The discharge plenum 60 includes a cylindrical insertion pipe 61, an expansion pipe 62 disposed at a front side of the insertion pipe 61 and having a diameter that is larger than that of the insertion pipe 61, and an expansion flange 63 that extends radially outward from an outer circumferential surface of the expansion pipe 62.

The valve stopper 65 may be disposed in the insertion pipe 61. The insertion pipe 61 includes a first pipe 611 disposed behind the valve stopper 65 and a second pipe 612 disposed in front of the valve stopper 65. The first pipe 611 extends rearward and the second pipe 612 extends forward from a radial outer end of the radial member 651 of the valve stopper 65.

The insertion pipe 61 is inserted into and coupled to the second inner diameter portion 22. When the insertion pipe 61 is inserted into the second inner diameter portion 22, the expansion pipe 62 and the expansion flange 63 are disposed at a groove which is defined at the flange 24 of the frame 20 and have a shape complementary to that of the expansion pipe 62 and the expansion flange 63.

A mount 64 is disposed at a front side of the expansion pipe 62 and in front of the expansion pipe 62. The mount 64 is engaged with the discharge cover 80 and may have a tubular shape with an inner diameter that is larger than that of the expansion pipe 62.

The discharge cover 80 includes an axial cover 81 that extends radially to cover an opening defined at a front side of the mount 64, a radial cover 82 that extends axially to cover an outer circumferential surface of the mount 64, and an engaging surface 83 that extends radially outward from a rear end of the radial cover 82.

When the discharge cover 80 is coupled to the mount 64, the coupling surface 83 of the discharge cover 80 faces the expansion flange 63.

The space provided by the axial cover 81 of the discharge cover 80, the second pipe 612, the expansion pipe 62, and the mount 64 of the discharge plenum 60 may be a discharge portion 88 where the high-pressure fluid discharged from the compression portion 44 is contained. A sealing ring is disposed between a rear surface of the coupling surface part 83 and a front surface of the expansion flange 63 to seal the high-pressure fluid in the discharge portion 88.

A discharge port 47 is defined at the axial cover 81 of the discharge cover 80 to supply the high-pressure fluid in the discharge portion 88 to a component in need. The component in need may be, for example, a condenser of a refrigeration cycle.

Figure 12:
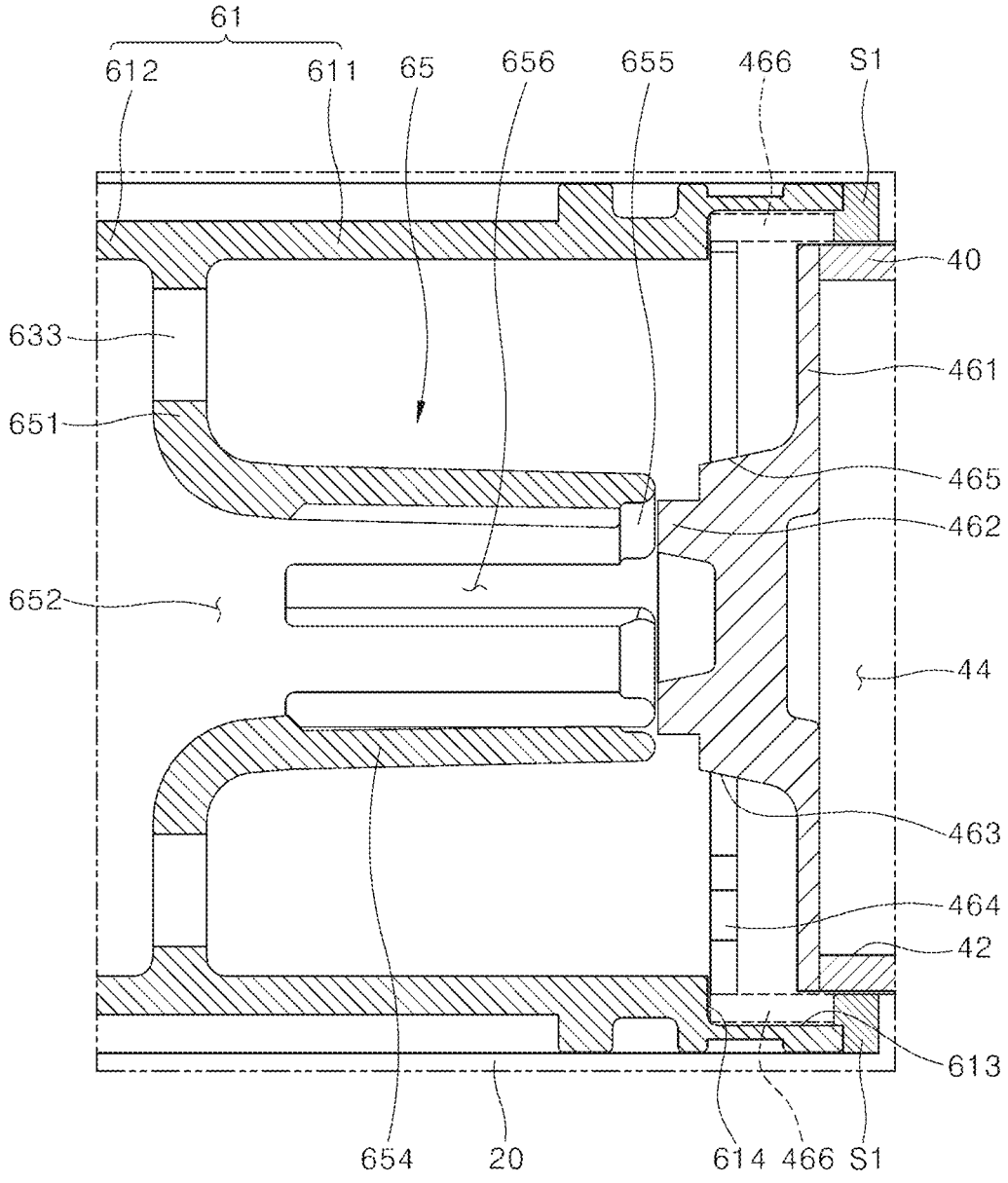
FIG. 12 is an enlarged cross-sectional view of the frame, the cylinder, the discharge plenum, a valve member, and a valve spring in FIG. 7.

Referring to FIG. 12, a rear end of the first pipe 611 of the insertion pipe 61 is spaced apart from an inward step 23 of a frame 20 in an axial direction, and a sealing member (S1) is disposed between the rear end of the first pipe 611 of the insertion pipe 61 and the inward step 23 of the frame 20 and is pressed. In addition, a spring holder 466 disposed on a valve mounter 613 provided at the rear end of the first pipe 611 also presses the sealing member (S1). An inner circumferential surface of the pressed sealing member (S1) may contact an outer circumferential surface of the cylinder 40. In this case, the leakage of the high-pressure fluid discharged into the discharge plenum 60 from the compression portion 44 is prevented.

Figure 10:
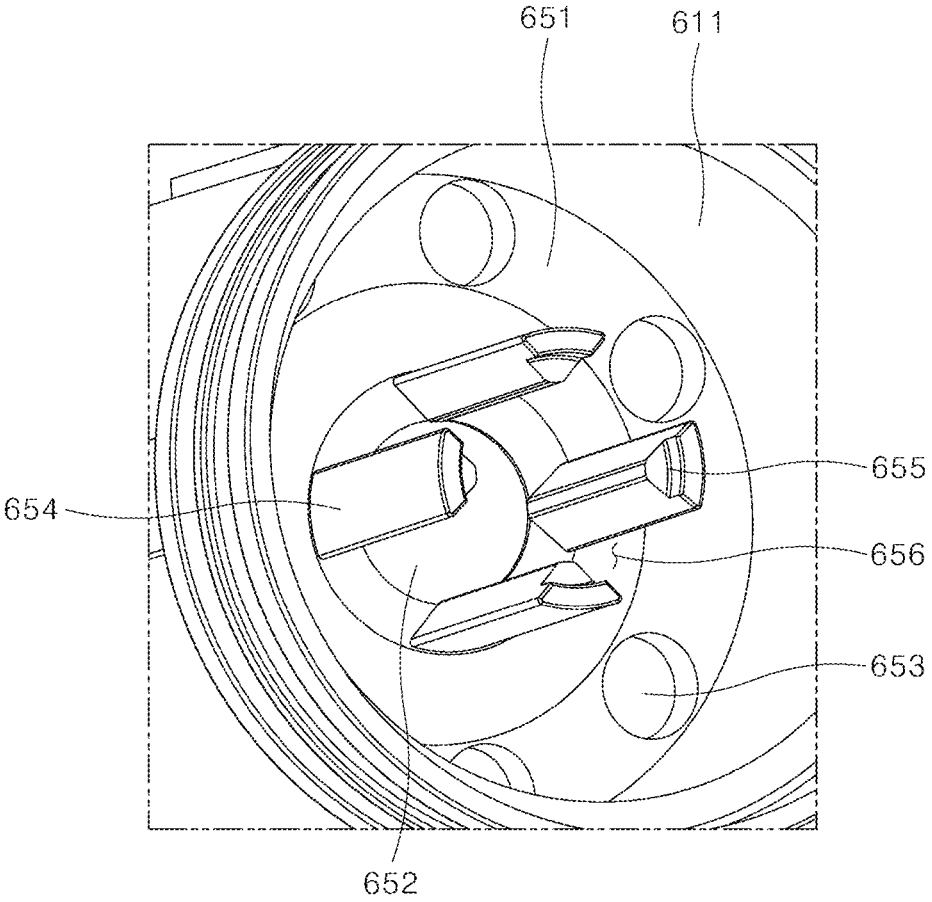
FIG. 10 is an enlarged view showing a valve stopper of the discharge plenum in FIG. 9.
Figure 11:
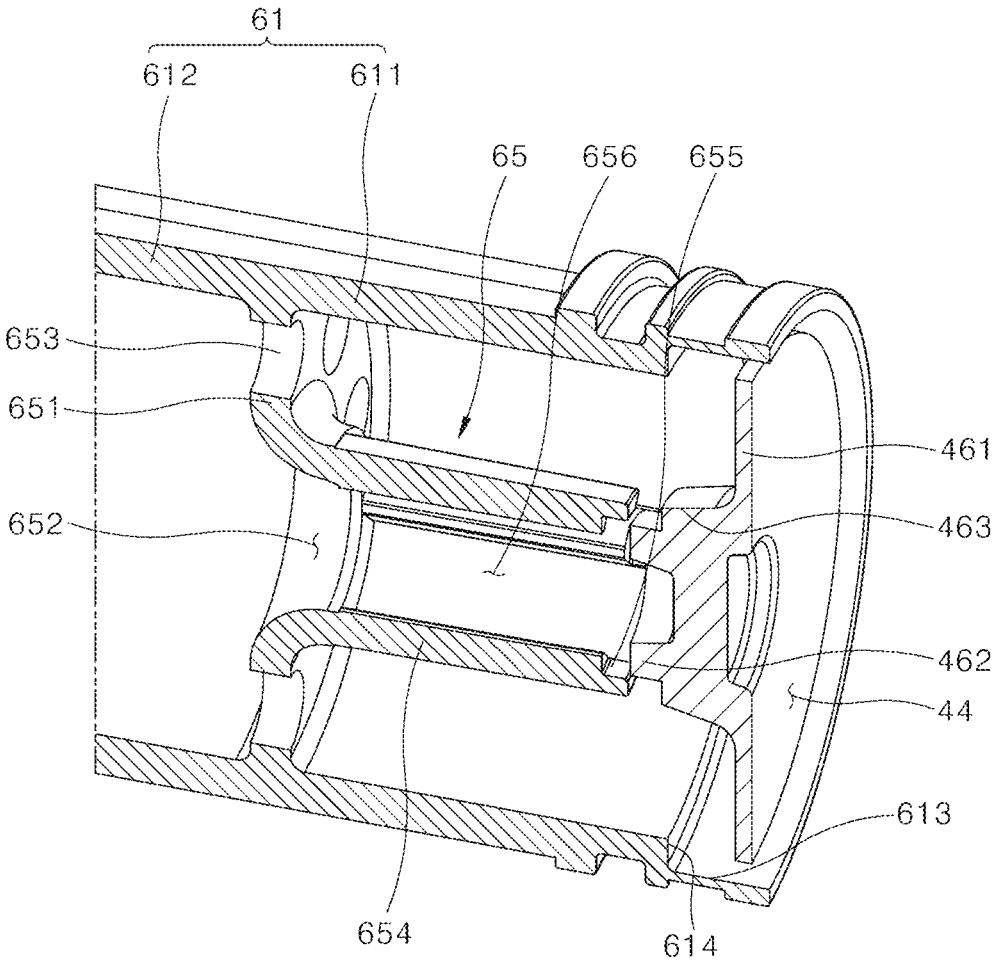
FIG. 11 is an enlarged cross-sectional perspective view showing a valve stopper of the discharge plenum and a valve member in FIG. 7.
Figure 16:
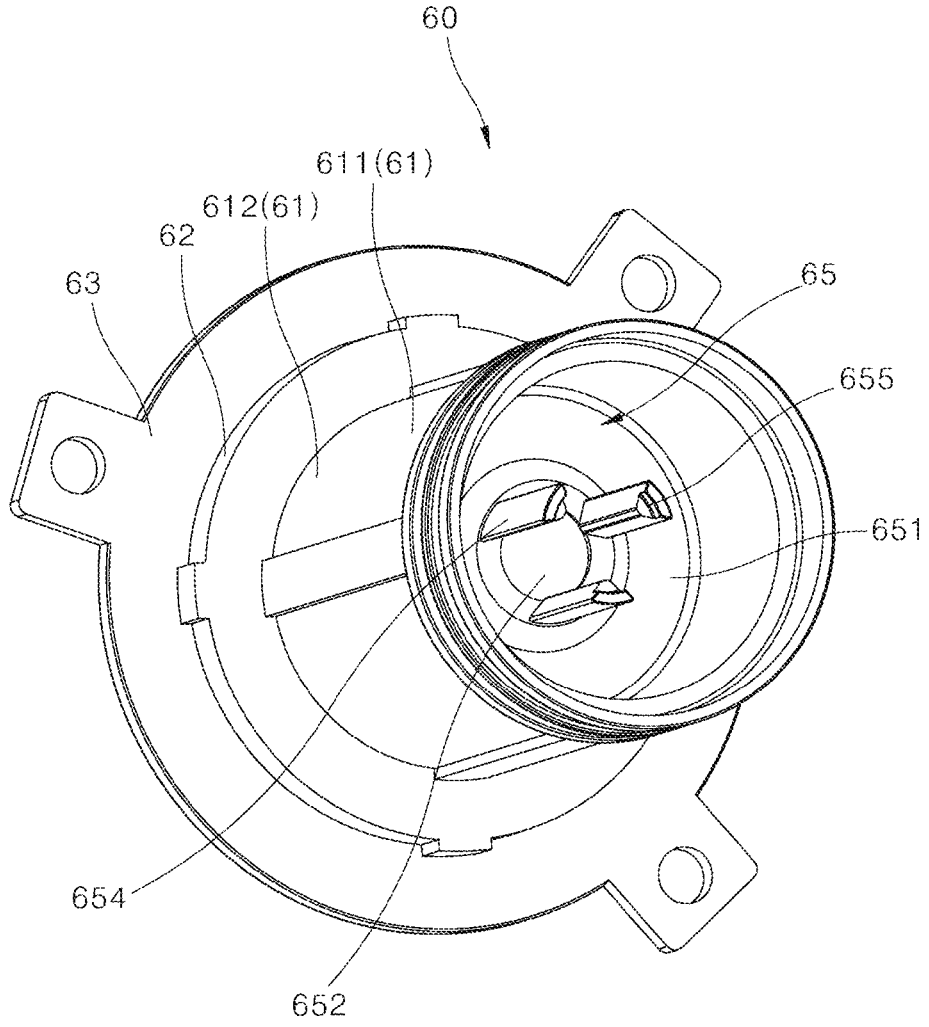
FIGS. 16 to 18 show modified examples of a discharge plenum.
Figure 18:
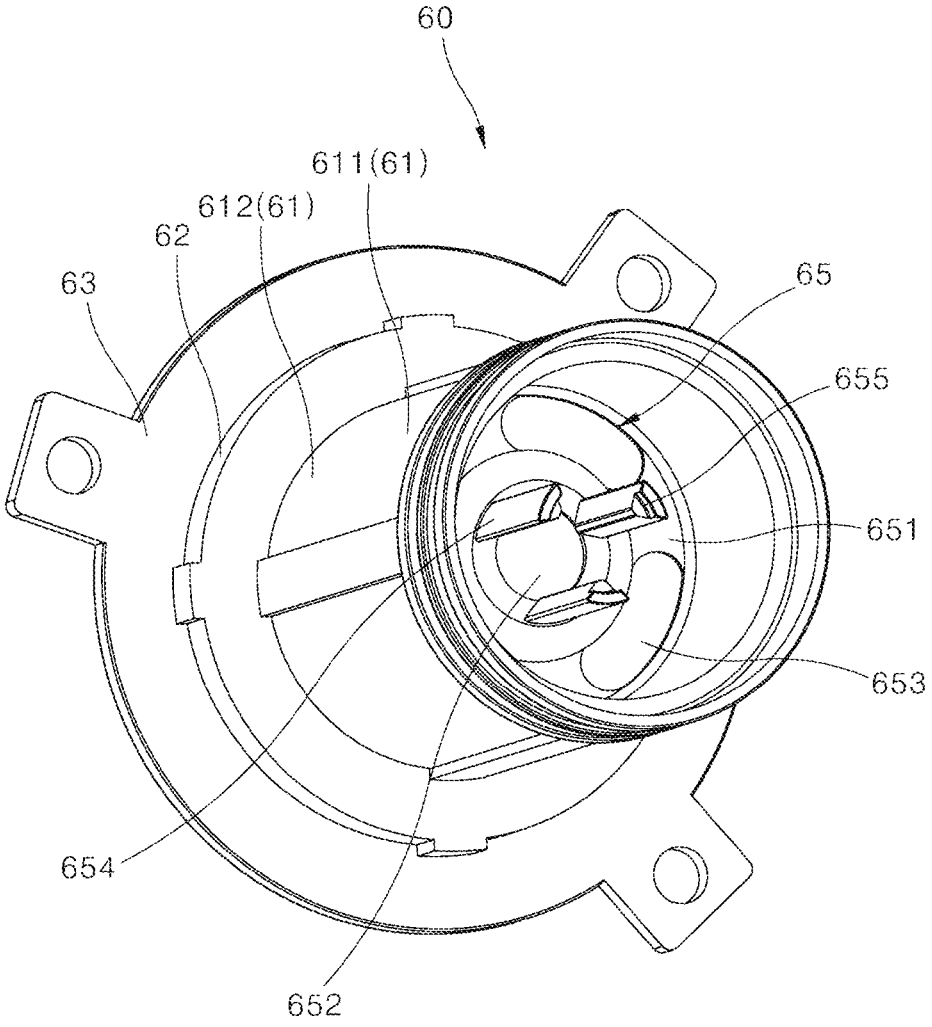

The radial member 651 of the valve stopper 65 provides a central hole 652. Peripheral holes 653 may be provided at the radial member 651 along a circumference of the central hole 652. The peripheral hole 653 communicates a rearward space of the valve stopper 65 with a forward space of the valve stopper 65. The peripheral hole 653 may have a circular shape as shown in FIG. 10. In addition, the peripheral hole 653 may be an arc-shaped hole as shown in FIG. 18. As shown in FIG. 16, the peripheral hole 653 may be omitted.

The peripheral hole 653 directly connects the rearward space of the radial member 651 to the forward space of the radial member 651 axially to greatly reduce the recirculation flow of the fluid described with reference to FIG. 3 and reduce energy loss by reducing the flow loss and the pressure loss.

The peripheral holes 653 may be provided at equal distances along a circumference of the central hole 652, and the distance between the peripheral holes 653 and a number of peripheral holes 653 are not limited. In addition, when the peripheral hole 653 has an elongated shape, a circumferential length of the elongated hole is also not limited.

The axial member 654 may have a pipe shape that extends axially and be open in the forward direction and the rearward direction by the central hole 652. That is, a radial inner space provided by the axial member 654 is open to the forward direction and the rearward direction. Therefore, the fluid contained in a space behind the axial member 654 may flow to a space in front of the axial member 654 through the inner space of the axial member 654.

In addition, the slot flow path 656 that extends axially is defined at the axial member 654. The slot flow path 656 may have a shape that extends in a forward and rearward direction, and a plurality of slot flow paths 656 may be defined at equal distances at the circumference of the axial member 654. The slot flow path 656 may be open in the rearward direction. That is, the slot flow path 656 may divide the rear portion of the axial member 654 circumferentially.

An axial length of the slot flow path 656 may be larger than a circumferential width of the slot flow path 656. The slot flow path 656 may extend to have the axial length that is equal to or larger than a half of an axial length of the axial member 654.

The axial member 654 restricts the axial displacement of the valve member 460 and the high-pressure fluid contained in a radial outer side of the axial member 654 may flow to a radial inner space of the axial member 654 through the slot flow path 656 when the valve member 460 interferes with the interference surface 655 of the axial member 654. The fluid in the radial inner space of the axial member 654 may be discharged into the discharge portion 88 through the central hole 652.

That is, the high-pressure fluid exiting from the compression portion 44 by pushing the valve member 460 may be discharged into the discharge portion 88 through the peripheral holes 653 or through the slot flow paths 656 and the central hole 652.

Figure 13:
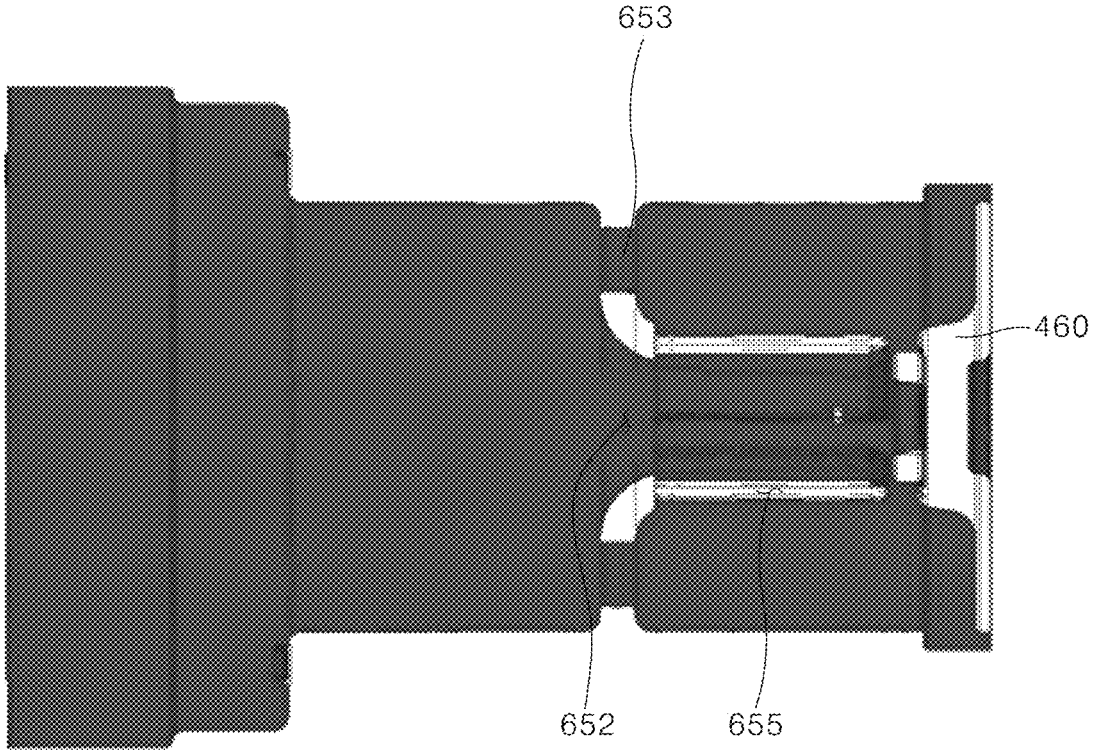
FIGS. 13 and 14 show pressure distribution and a velocity vector of fluid determined when the fluid is discharged from the compression portion of the linear compressor of FIG. 7, respectively.
Figure 14:
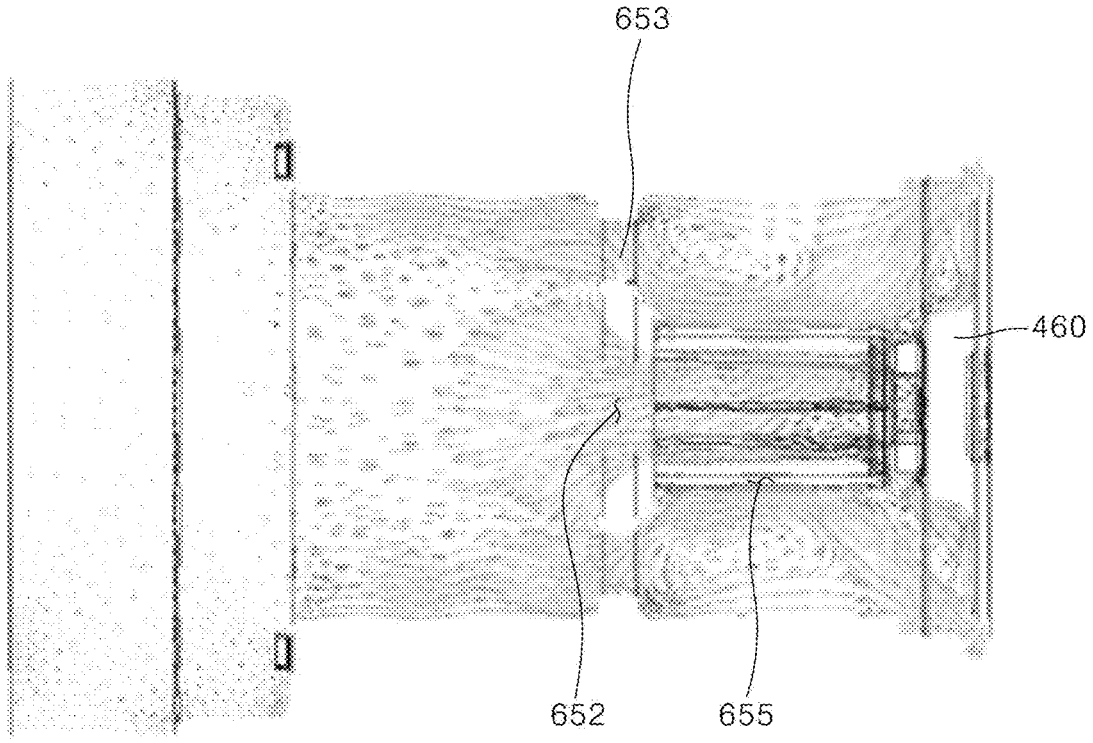
Figure 15:
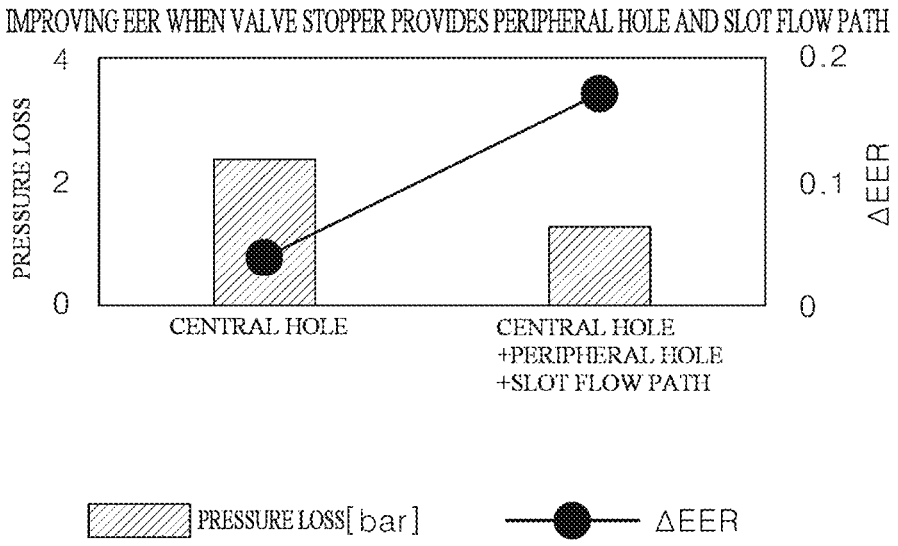
FIG. 15 is a graph showing an amount of pressure loss and energy efficiency rate (EER) varying depending on presence or absence of peripheral holes and slot flow paths of a valve stopper.

Pressure drop does not occur in the valve stopper 65 defining the peripheral holes 653 and the slot flow paths 656 as shown in FIG. 13. Energy loss occurring due to the concentrated flow and the excessively rapid flow rate may be minimized by the valve stopper 65 providing the peripheral holes 653 and the slot flow paths 656 as shown in FIG. 14.

The valve stopper 65 providing the peripheral holes 653 and the slot flow paths 656 has higher energy efficiency rate (EER) and reduced pressure loss than other valve stoppers.

Figure 17:
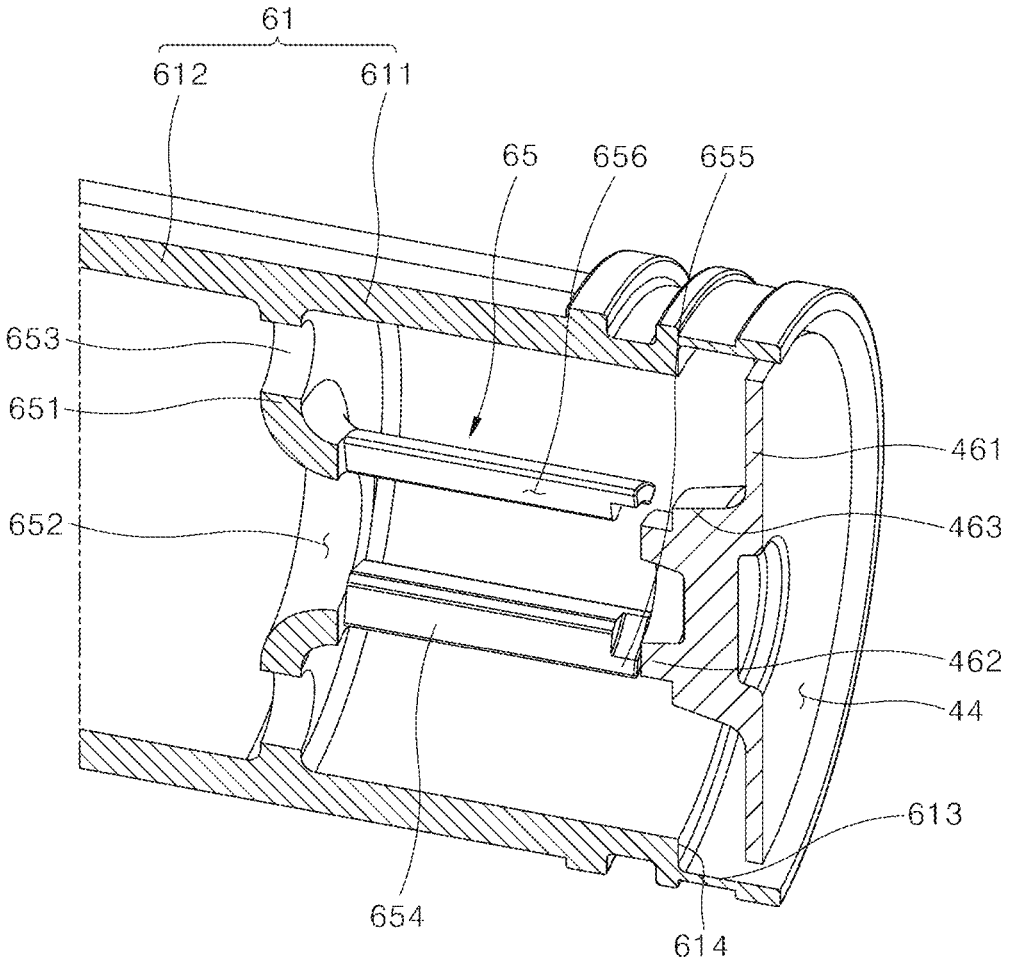

In FIGS. 7 to 12, the structure of the valve stopper 65 including four slot flow paths 656 provided at a 90 degree angle in the circumferential direction is shown. However, the number of slot flow paths 656 is not limited thereto. For example, as shown in FIGS. 16 to 18, three slot flow paths 656 having a circumferential width that is larger than that of the slot flow path 656 in FIGS. 7 to 12 may be provided at a 120 degree angle.

Figure 19:
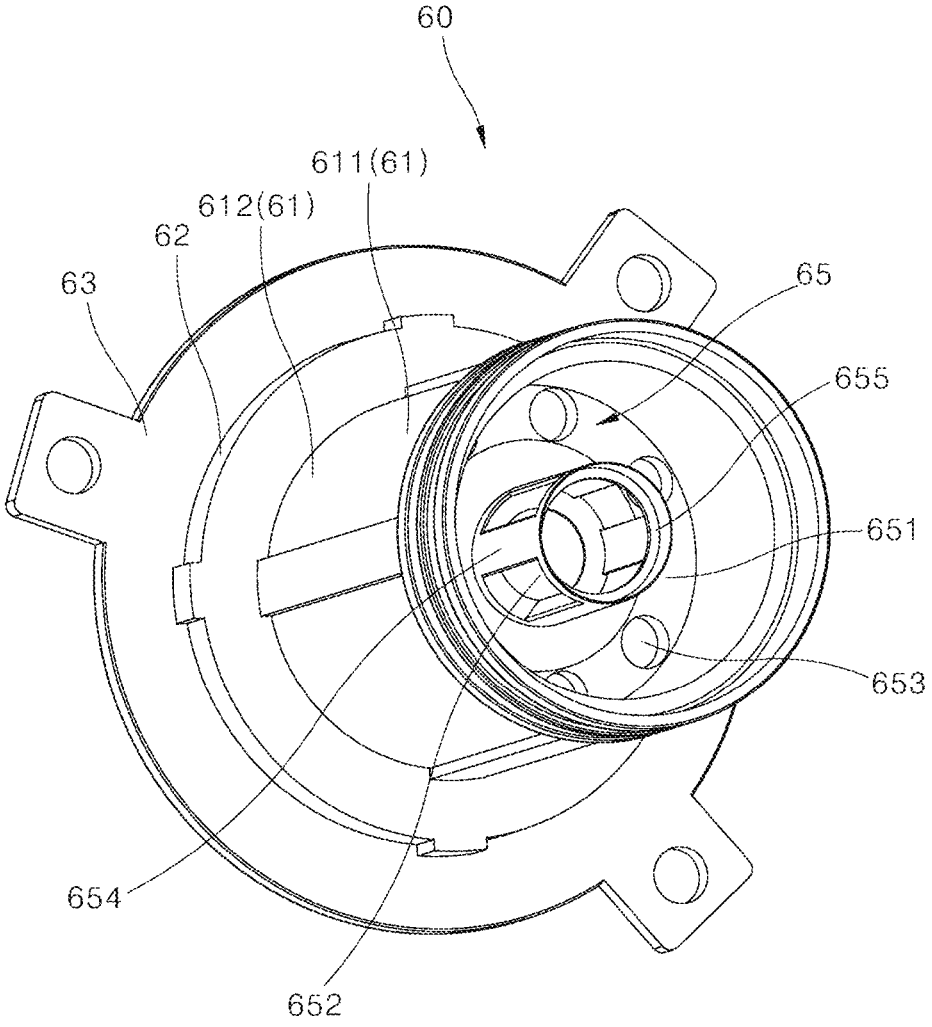
FIGS. 19 and 20 show another modified examples of a discharge plenum.
Figure 20:
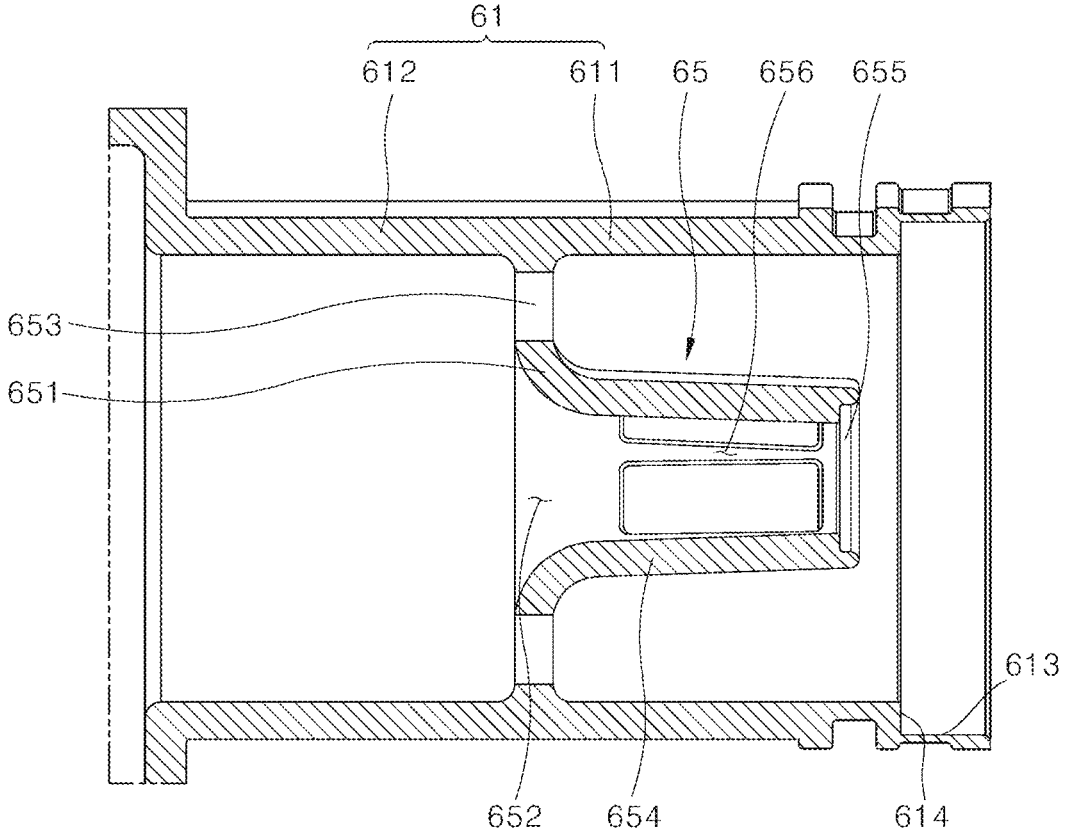

In addition, the slot flow path 656 is not limited to the slot flow path that is open in the rearward direction. As shown in FIGS. 19 and 20, four slot flow paths 656 may extend longitudinally and axially and may not be opened in the rearward direction. That is, the slot flow path 656 does not divide the rear portion of the axial member 654. In this case, the interference surface 655 may have a closed loop ring shape, and higher strength of the axial member 654 than that of the cantilever axial member 654 having the protruding rear portion (see FIGS. 7 to 17) may be obtained.

The interference surface 655 is disposed on an inner circumferential surface at the rear end of the axial member 654. When the axial protrusion 462 of the valve member 460 moves forward excessively, the rear end of the axial member 654 may be deformed radially outward. However, even though a radial middle portion of the valve stopper 65 shown in FIGS. 19 and 20 is divided by the slot flow path 656, the rear end of the axial member 654 has a ring shape such that rear end of the axial member is not deformed in the radial outward direction.

The frame 20, the cylinder 40, and the piston 50 may each be made of metal to obtain the strength and wear resistance. The discharge plenum 60, which has a complicated shape and does not require the strength and the wear resistance, may be made of synthetic resin.

The axial member 654 may have a truncated cone profile that gradually decreases in diameter in the rearward direction. The fact that the outer circumferential surface of the axial member 654 has the truncated cone profile that gradually decreases in the rearward direction signifies that a cross-sectional area of a radial outside space of the axial member 654 decreases in the forward direction. In addition, the fact that an inner circumferential surface of the axial member 654 has the truncated cone profile that gradually decreases in the rearward direction signifies that a cross-sectional area of a radial inner space of the axial member 654 increases in the forward direction.

The fluid having discharged from the compression portion 44 flows forward in the radial outer space of the axial member 654. A flow cross-sectional area of the radial outer space of the axial member 654 gradually decreases in the forward direction thereof Therefore, the fluid flowing forward in the radial outer space of the axial member 654 is induced to flow into the radial inner space of the axial member 654 through the slot flow path 656.

In addition, as the flow cross-sectional area of the radial inner space of the axial member 654 gradually increases in the forward direction, the fluid introduced into the radial inner space of the axial member 654 through the slot flow path 656 is induced to flow forward through the central hole 652.

The flow induction effect may be obtained based on a tapered structure of the axial member 654 that gradually decreases in the rearward direction and the slot flow path 656 of the axial member 654 having an axially longitudinal shape.

The frame 20 may be made of metal to withstand the pressure of the high-pressure fluid compressed by the compressor. As the discharge plenum 60 is inserted into the second inner diameter portion 22 of the frame 20 and is reinforced by the frame 20, the discharge plenum 60 may not need to additionally obtain a high strength. As the discharge plenum 60 has the complicated shape including the valve stopper 65, the discharge plenum 60 may be made of synthetic resin. For example, the discharge plenum 60 may be manufactured by injection molding.

The axial member 654 has the substantially truncated cone profile such that the discharge plenum 60 is easily taken out from a mold after the injection molding.

The step 614 defined at the rear end of the first pipe 611 of the discharge plenum 60 has an inner diameter that increases in the rearward direction of the valve stopper 65. With this structure, the discharge plenum 60 is easily taken out from the mold in a forward direction thereof after forming the rear surface of the valve stopper 65 and the inner circumferential surface of the first pipe 611 in the injection mold.

In addition, the inner diameter of the discharge plenum 60 increases in the rearward direction of the valve stopper 65, for example, from the second pipe 612 to the mount 64 of the discharge plenum 60. With this structure, the discharge plenum 60 is easily taken out from the mold in a rearward direction after molding the inner circumferential surface thereof by the injection molding.

Although the present disclosure has been described as described above with reference to exemplary drawings, the present disclosure is not limited to the embodiments and drawings disclosed herein, and various modifications can be made by those skilled in the art within the scope of the technical idea of the present disclosure. In addition, even if working effects obtained based on configurations of the present disclosure are not explicitly described in the description of embodiments of the present disclosure, effects predictable based on the corresponding configuration have to be recognized.

What is claimed is:

1. A compressor, comprising:

a cylinder that extends axially and defines an inlet at a first axial end and an outlet at a second axial end;

a piston disposed in the cylinder and configured to reciprocate in the cylinder;

a discharge valve assembly disposed at the outlet of the cylinder and configured to open and close the outlet of the cylinder; and a valve stopper configured to limit a degree of opening of the discharge valve assembly, the valve stopper comprising:

a radial member that extends radially and defines a central hole, the radial member having a radial inner end that surrounds the central hole, an axial member that extends in a first axial direction from the radial inner end of the radial member, the axial member defining a hollow space that is in fluid communication with the central hole, and an interference surface disposed at a first axial end of the axial member and configured to, based on the discharge valve assembly opening the outlet of the cylinder, interfere with the discharge valve assembly to thereby limit the degree of opening of the discharge valve assembly, wherein the compressor further comprises:

a first pipe that is connected to a radial outer end of the radial member and extends from the radial outer end of the radial member in the first axial direction, and a valve mounter that is disposed at an axial end of the first pipe and couples the discharge valve assembly to the cylinder, wherein the axial member further defines a slot flow path that passes through a circumference of the axial member in a radial direction such that the hollow space of the axial member is in fluid communication with an outer space outside the circumference of the axial member.

2. The compressor of claim 1, wherein the discharge valve assembly comprises:

a valve member configured to open and close the outlet of the cylinder;

a valve spring configured to apply force to the valve member in a direction of closing the outlet of the cylinder; and a spring holder configured to support the valve spring.

3. The compressor of claim 1, further comprising a frame that accommodates at least a portion of each of the cylinder and the discharge valve assembly, the frame comprising:

a first inner diameter portion disposed at a first axial side of the frame;

a second inner diameter portion that is concentric with the first inner diameter portion and disposed at a second axial side of the frame; and an inward step that is disposed axially between the first inner diameter portion and the second inner diameter portion, the inward step protruding radially inward relative to the first inner diameter portion and the second inner diameter portion, wherein the cylinder is inserted into and coupled to the first inner diameter portion of the frame, the cylinder having a discharge side end that is disposed at the second inner diameter portion and defines the outlet, and wherein the discharge valve assembly is accommodated in the second inner diameter portion and disposed axially between the outlet of the cylinder and the valve mounter.

4. The compressor of claim 1, further comprising:

a second pipe that is connected to the radial outer end of the radial member and extends from the radial outer end of the radial member in a second axial direction opposite to the first axial direction; and a discharge cover connected to an axial end of the second pipe, wherein the second pipe and the discharge cover define a discharge portion configured to receive a high-pressure fluid discharged from the cylinder through the discharge valve assembly.

5. The compressor of claim 1, wherein the hollow space is in fluid communication with a space defined at a first axial side of the valve stopper facing the discharge valve assembly.

6. The compressor of claim 1, wherein the interference surface has a closed loop ring shape.

7. The compressor of claim 1, wherein the axial member has a truncated cone shape, and a diameter of the axial member decreases along the first axial direction.

8. The compressor of claim 1, wherein the slot flow path has a straight shape that extends in the first axial direction, and an axial length of the slot flow path is greater than a circumferential length of the slot flow path.

9. The compressor of claim 8, wherein an axial end of the slot flow path in the first axial direction is closed.

10. The compressor of claim 8, wherein the slot flow path is one of a plurality of slot flow paths that are defined at the circumference of the axial member, the plurality of slot flow paths being spaced apart from one another by an equal circumferential distance.

11. The compressor of claim 8, wherein an axial end of the slot flow path in the first axial direction is open.

12. The compressor of claim 1, wherein the radial member defines peripheral holes that pass through the radial member in the first axial direction such that a first space defined at a first axial side of the valve stopper is in fluid communication with a second space defined at a second axial side of the valve stopper through the peripheral holes.

13. The compressor of claim 12, wherein the peripheral holes include an arc-shaped elongated hole, wherein a circumferential length of the arc-shaped elongated hole is greater than a radial length of the arc-shaped elongated hole.

14. The compressor of claim 12, wherein the peripheral holes are spaced apart from one another by an equal circumferential distance.

15. A compressor, comprising:

a cylinder that extends axially and defines an inlet at a first axial end and an outlet at a second axial end;

a piston that is disposed in the cylinder and configured to reciprocate in the cylinder;

a linear motor configured to drive the piston;

a discharge valve assembly disposed at the outlet of the cylinder and configured to open and close the outlet of the cylinder; and a valve stopper configured to limit a degree of opening of the discharge valve assembly, the valve stopper comprising:

a radial member that extends radially and defines a central hole, the radial member having a radial inner end that surrounds the central hole, an axial member that extends from the radial inner end of the radial member in a first axial direction, the axial member defining a hollow space that is in fluid communication with the central hole, and an interference surface disposed at an axial end of the axial member and configured to, based on the discharge valve assembly opening the outlet of the cylinder, interfere with the discharge valve assembly to thereby limit the degree of opening of the discharge valve assembly, wherein the compressor further comprises:

a first pipe that is connected to a radial outer end of the radial member and extends from the radial outer end of the radial member in the first axial direction, and a valve mounter that is disposed at an axial end of the first pipe and couples the discharge valve assembly to the cylinder, wherein the radial member defines a peripheral hole that passes through the radial member in the first axial direction such that a first space defined at a first axial side of the valve stopper is in fluid communication with a second space defined at a second axial side of the valve stopper through the peripheral hole, and wherein the axial member further defines a slot flow path that passes through a circumference of the axial member in a radial direction such that the hollow space of the axial member is in fluid communication with an outer space outside the circumference of the axial member.

16. The compressor of claim 15, wherein the axial member has a truncated cone shape, and a diameter of the axial member decreases along the first axial direction.

17. The compressor of claim 15, wherein the peripheral hole is one of a plurality of peripheral holes that are defined at the radial member and spaced apart from one another by an equal circumferential distance.

18. The compressor of claim 15, wherein the peripheral hole comprises an arc-shaped elongated hole, wherein a circumferential length of the arc-shaped elongated hole is greater than a radial length of the arc-shaped elongated hole.

19. The compressor of claim 15, wherein the hollow space defined by the axial member is in fluid communication with the first space defined at the first axial side of the valve stopper.

20. A compressor, comprising:

a cylinder that extends axially and defines an inlet at a first axial end and an outlet at a second axial end;

a piston disposed in the cylinder and configured to reciprocate in the cylinder;

a discharge valve assembly disposed at the outlet of the cylinder and configured to open and close the outlet of the cylinder; and a valve stopper configured to limit a degree of opening of the discharge valve assembly, the valve stopper comprising:

a radial member that extends radially and defines a central hole, the radial member having a radial inner end that surrounds the central hole, an axial member that extends in a first axial direction from the radial inner end of the radial member, the axial member defining a hollow space that is in fluid communication with the central hole, and an interference surface disposed at a first axial end of the axial member and configured to, based on the discharge valve assembly opening the outlet of the cylinder, interfere with the discharge valve assembly to thereby limit the degree of opening of the discharge valve assembly, wherein the axial member further defines a slot flow path that passes through a circumference of the axial member in a radial direction such that the hollow space of the axial member is in fluid communication with an outer space outside the circumference of the axial member, and wherein the axial member has a truncated cone shape, and a diameter of the axial member decreases along the first axial direction.

* * * * *